United States Patent [19]

Wagner

[11] Patent Number: 4,989,441

[45] Date of Patent: Feb. 5, 1991

[54] TUBE-BENDING DEVICE

[75] Inventor: Rudolf Wagner, Stuggart, Fed. Rep. of Germany

[73] Assignee: REMS-WERK Christian Föll und Söhne GmbH & Co., Waiblingen, Fed. Rep. of Germany

[21] Appl. No.: 306,380

[22] Filed: Feb. 3, 1989

[30] Foreign Application Priority Data

Feb. 3, 1988 [DE] Fed. Rep. of Germany ..... 3803128

[51] Int. Cl.[5] ..... B21D 7/08

[52] U.S. Cl. ..... 72/389; 72/458; 72/477; 72/213; 72/481

[58] Field of Search ..... 72/389, 458, 477, 481, 72/385, 413, 321, 212, 213, 478, 442

[56] References Cited

U.S. PATENT DOCUMENTS

| | | | |
|---|---|---|---|
| 1,079,442 | 11/1913 | Rutledge | 72/389 |
| 3,069,944 | 12/1962 | Baumgartner | 72/477 |
| 3,199,549 | 8/1965 | Wallshein | 72/213 |
| 3,464,254 | 9/1969 | Le Breton | 72/389 |
| 3,507,141 | 4/1970 | Fisher | 72/389 |
| 3,822,578 | 7/1974 | Le Breton | 72/389 |
| 4,790,068 | 12/1988 | Sato | 72/410 |
| 4,825,682 | 5/1989 | Orav et al. | 72/416 |

FOREIGN PATENT DOCUMENTS

| | | | |
|---|---|---|---|
| 0213113 | 11/1957 | Australia | 72/389 |
| 2303475 | 8/1974 | Fed. Rep. of Germany | 72/389 |
| 1752788 | 7/1976 | Fed. Rep. of Germany . | |
| 0799257 | 6/1936 | France | 72/389 |
| 0204045 | 11/1983 | German Democratic Rep. | 72/389 |

*Primary Examiner*—David Jones

*Attorney, Agent, or Firm*—Robert W. Becker & Associates

[57] ABSTRACT

A tube-bending device that includes a main body on which is pivotably mounted a ratchet lever that via a driving pawl engages a ratchet bar that is displaceably guided in the main body and is provided for an anvil. A detent is also pivotably mounted on the main body and engages the ratchet bar. A holder is provided on the main body, with a first pair of blocks disposed on the one side of the holder, and a second pair of blocks being disposed on the other side of the holder. A respective one of the pairs of blocks is provided for supporting a tube during a bending process.

19 Claims, 2 Drawing Sheets

TUBE-BENDING DEVICE

BACKGROUND OF THE INVENTION

The present invention relates to a tube-bending device that includes a main body on which is pivotably mounted a ratchet lever that via a driving pawl engages a ratchet bar that is displaceably guided in the main body and is provided for an anvil, with a detent also being pivotably mounted on the main body and engaging the ratchet bar.

With one heretofore known tube-bending device (German Patent No. 17 52 788 Breton dated July 29, 1976), a holder is detachably secured to the main body along with a pair of blocks for supporting a tube during a bending process. In order to be able to bend different radii, the blocks must be spaced at varying distances from one another. Consequently, with the heretofore known tube-bending device at least two holders with appropriate pairs of blocks are needed, as a result of which this known tube-bending device is relatively expensive. In addition it is impossible or at least very difficult, to support this tube-bending device upon a table or other base during a bending process, so that it is difficult to apply great bending forces.

It is therefore an object of the present invention to embody a tube-bending device of the aforementioned general type in such a way that it becomes possible with a structurally straightforward configuration and in an economical manner to bend tubes in a simple manner.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
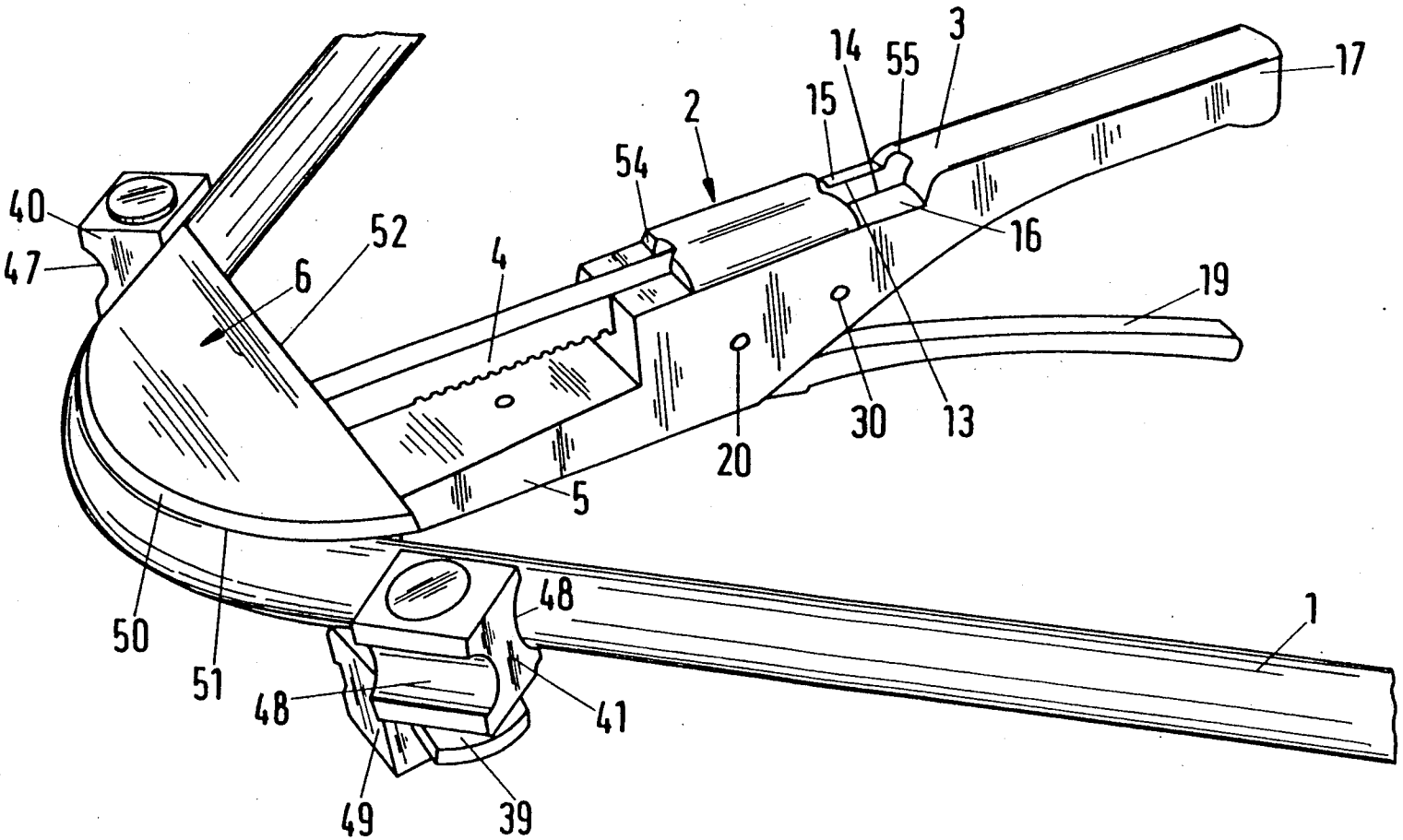
FIG. 1 is an isometric view of one exemplary embodiment of the inventive tube-bending device, which is shown in the process of bending a tube.

The tube-bending device of the present invention is characterized primarily in that a holder is provided on the main body, with this holder having two sides, with a first pair of blocks being disposed on one of the sides of the holder, and a second pair of blocks being disposed on the other side of the holder, with a respective one of these pairs of blocks being provided for supporting a tube during a bending process, whereby the anvil is adapted, via displacement of the ratchet bar, to engage the tube.

With the inventive tube-bending device, the holder is provided with two pairs of blocks. That pair of blocks that is not needed during the bending process can be used to support the tube-bending device on a base or table. Therefore, during the bending process the inventive tube-bending device can be satisfactorily supported upon the base. If the tube-bending device rests upon a base, relatively great forces can be applied during the bending process, so that also larger or thicker tubes can be reliably bent. Since for each holder two pairs of blocks are provided, it is necessary to have only a low number of holders. As a result, it is much more economical to purchase the inventive tube-bending device; in addition, storage costs are reduced.

Further specific features of the present invention will be described in detail subsequently.

DESCRIPTION OF PREFERRED EMBODIMENTS

Referring now to the drawings in detail, the tube-bending device serves to bend tubes 1 (see FIG. 1) in such a way that they have a respectively desired radius. The tube-bending device has a main body 2 that includes a rear guide part 3 that has a U-shaped cross-sectional configuration and serves to accommodate a ratchet bar 4 for an anvil 6, and a front support and guide part 5. The guide part 3 has its greatest height where it is connected to the support and guide part 5 (FIG. 1), and becomes narrower in the direction toward its free end. The support and guide part 5 has an essentially constant height, and is flatter than the guide part 3.

Figure 2:
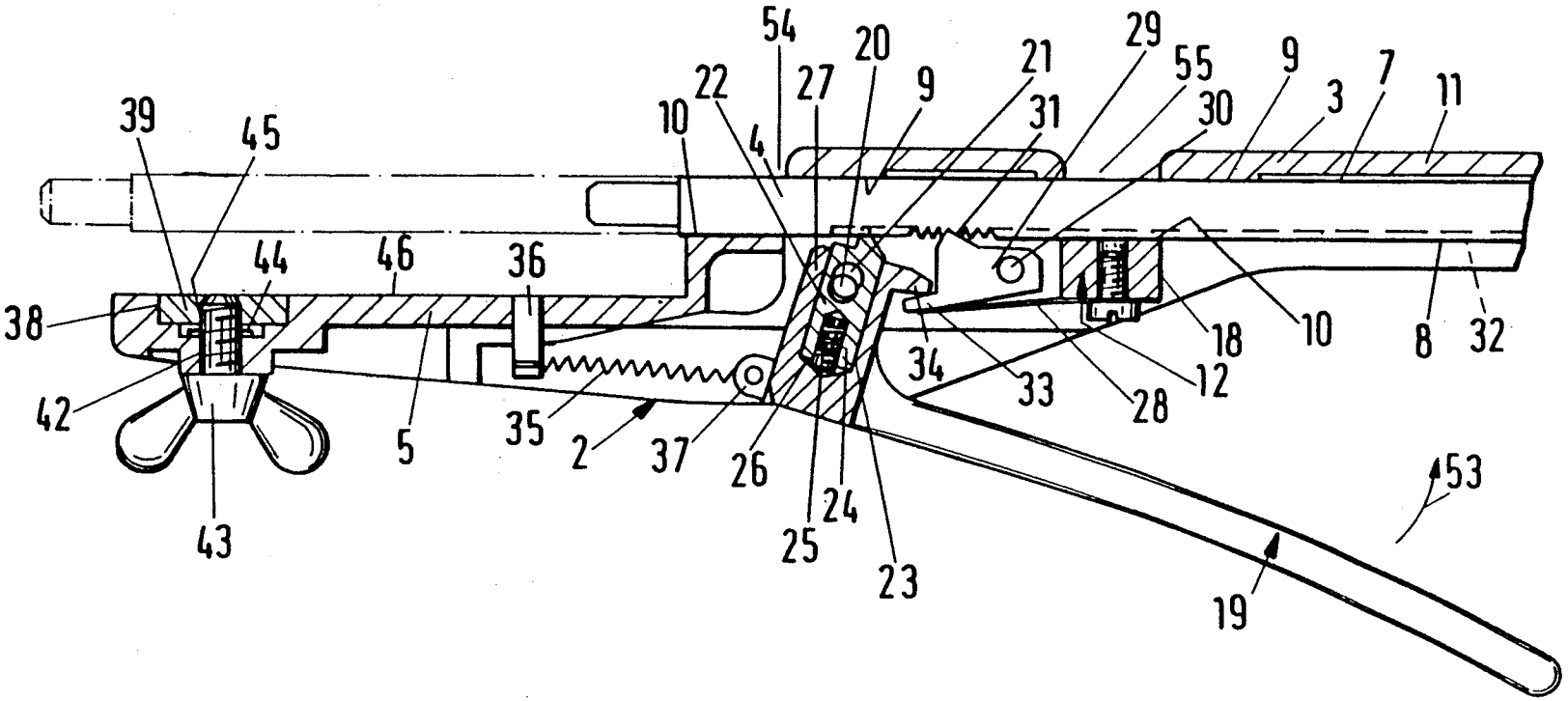
FIG. 2 is a cross-sectional view through a portion of the tube-bending device of FIG. 1.

The ratchet bar 4 is displaceably mounted in the guide part 3. The ratchet bar 4 has a rectangular cross-sectional shape, with the top 7 and bottom 8 of the ratchet bar 4 being guided on guide surfaces 9 and 10 of the guide part 3. As shown in FIG. 2, several guide surfaces 9 are provided along which the ratchet bar 4 is guided during the process of bending a tube. The guide surfaces 9 are provided on the underside of the crosspiece 11 of the guide part 3. The crosspiece 11 could also be embodied in such a way that its underside is planar throughout, so that in this case the ratchet bar 4 rests against this underside 9 of the crosspiece 11, which underside forms the guide surface. The guide surfaces 10 are disposed across from the guide surfaces 9 and are provided on a support part 12 of the main body 2. The support part 12 is considerably shorter than the guide part 3, so that in the region beyond the support part 12, the ratchet bar 4 is guided only on the guide surfaces 9 of the guide part 3.

In addition to the guide surfaces 9 and 10, further guide surfaces 13 and 14 (FIG. 1) are provided that are formed by the facing inner sides of the legs 15, 16 of the U-shaped guide part 3. Thus, in the region of the support part 12, the ratchet bar 4 is guided on all four sides, whereas in the region beyond the support part 12, the ratchet bar 4 is guided on only the three guide surfaces 9, 13, and 14. As a consequence of the guide means described above, the ratchet bar 4 is reliably shifted in the guide part 3 in such a way that it does not tilt.

At that end that is remote from the support and guide part 5, the legs 15 and 16 of the guide part 3 are connected to one another by an end wall 17 that is disposed perpendicular to them. This end wall 17 serves as a stop for the ratchet bar 4 in its retracted end position. During a ratcheting action, the ratchet bar 4 is shifted to the left in FIG. 2. The other end position of the ratchet bar 4 is shown by dot-dashed lines in FIG. 2. In this end position, a non-illustrated stop of the ratchet bar 4 abuts the end face 18 of the support part 12.

To operate the ratchet bar 4, a ratchet lever 19 is pivotably mounted between the legs 15 and 16 of the guide part 3. The journal pin 20 of the ratchet lever 19 is secured in the legs 15, 16 of the guide part 3 and extends through an oblong hole 21 in a driving pawl 22 that is mounted in a slot 23 at one end of the ratchet lever 19 in such a way that it is displaceable to a limited extent. The driving pawl 22 has a blind hole 24 for accommodating a compression spring 25 that is supported against the base 26 of the slot 23. The compression spring 25 loads the driving pawl 22 in the direction toward its engagement position, so that during the ratcheting procedure the driving pawl 22 can reliably engage the ratchet bar 4.

The slot 23 for the driving pawl 24 is provided in a sleeve-like end portion 27 of the ratchet lever 19.

Secured on that side of the support part 12 remote from the guide surface 10 is a leaf or flat spring 28 that extends in a direction toward the end portion 27 of the ratchet lever 19, and loads a catch or detent 29 in the direction toward its engagement position. The detent 29 is pivotably mounted between the legs 15, 16 of the guide part 3 on a journal pin 30, the ends of which are secured in the legs 15, 16. The detent 29 is provided with a tooth or projection 31 that can engage the ratchet teeth 32 of the ratchet bar 4.

The detent 29 is provided with a projection 33 that extends in a direction toward the end portion 27 of the ratchet lever 19, and over which extends a corresponding projection 34 on the end portion 27 (see FIG. 2).

By means of a tension spring 35, the ratchet lever 19 i s loaded in the starting position illustrated in FIG. 2. The tension spring 35 is mounted on an attachment part 36 provided in the supporting guide part 5 and on an eye 37 of the ratchet lever 19.

The free end of the support and guide part 5 is provided with a recessed portion 38 that extends perpendicular t o the axis of the ratchet bar 4. Engaging in the recessed portion 38 is a bar-like holder 39, the two ends of which support blocks 40 and 41 (FIG. 1). In the central portion of the recessed portion 38 is provided a through bore 42 for a wing-headed screw 43 that is prevented from falling out by a retainer ring 44. The central portion of the holder 39 is provided with a threaded bore 45 in which is screwed the wing-headed screw 43 in order to secure the holder 39. The thickness of the holder 39 is such that it is flush with a planar support surface 46 of the support and guide part 5.

The blocks 40, 41 at the ends of the holder 39 are each rotatably mounted and are provided on opposite sides with recesses 47, 48 that have the shape of part of a circle; a tube 1 engages the recesses 47 48 on one side of the blocks 40 41 during the bending process. Since the blocks 40, 41 are freely rotatable, they can automatically conform to the position of the tube in the bending range during the bending process.

On that side opposite the blocks 40, 41, the holder 39 is provided with two further blocks, with only the one block 49 being recognizable in FIG. 1. As was the case with the blocks 40, 41, the blocks 49 are freely rotatably mounted on the holder 39. The distance of the blocks 49 from one another is less than the distance between the blocks 40, 41. For this reason, the blocks 49 are used to produce smaller bending radii.

As can be seen from FIG. 1, in plan the anvil 6 has the shape of a segment of a circle. The outer side 50 of the anvil 6 is provided with a recessed portion 51, which has a partially circular cross-sectional shape, for receiving the tube 1 during the tube-bending process. The linear outer side 52 of the anvil 6 is provided with a non-illustrated recessed portion into which the end of the ratchet bar 4 extends. Into this recess extends one leg of a non-illustrated L-shaped spring, the other leg of which is detachably secured in a further recessed portion on the outer side 52 of the anvil 6. That spring leg that extends into the recessed portion provided for the ratchet bar 4 preferably extends over the entire length of this recessed portion. The L-shaped spring is disposed in such a way that when the anvil 6 is placed upon the end of the ratchet bar, that spring end that is disposed in the recessed portion is resiliently bent back and rests against one side of the ratchet bar. As a result of this spring, the anvil 6 rests with frictional engagement upon the free end of the ratchet bar 4. Since the anvil 6 is held via frictional engagement upon the end of the ratchet bar 4, it can easily be placed thereon or removed therefrom. In addition, as a result of this construction, the ratchet bar 4 can be easily and economically produced. It is merely necessary that the ratchet bar have an appropriate length.

In accordance with the desired bending radius of the tube 1, anvils 6 of various sizes can be placed upon the free end of the ratchet bar 4. The bending radius of the tube 1 is fixed by the curvature of the outer side 50, i.e. the recessed portion 51 of the anvil 6 In conformity with the desired bending radius, the holder 39 is secured in the recessed portion 38 in such a way that the blocks 40, 41 needed for the desired bending radius are provided for receiving the tube 1 during the bending process. To provide a larger bending radius during the tube-bending process, the blocks 40, 41 (FIG. 1) are used, and to obtain a smaller bending radius the blocks 49 that are not spaced as far from one another are used.

Initially, the ratchet bar 4 is in its rear end position, as illustrated by solid lines in FIG. 2. On that end of the ratchet bar 4 that extends beyond the guide part 3, the desired anvil 6 is placed and is held in the described manner via frictional engagement by the L-shaped spring. The holder 39 is secured in the recessed portion 38 in such a way that the appropriate blocks 40, 41 or 49 are disposed in the bending region. Subsequently, the ratchet lever 19 is pressed, against the force of the tension spring 35, in a direction toward the main body 2 (the arrow 53 in FIG. 2). Via the driving pawl 22, the ratchet bar 4 during this process is shifted in a known manner in a direction toward the holder 39. When the ratchet lever 19 is pressed, the ratchet bar 4 ratchets over the detent 29, which under the force of the flat spring 28 engages the teeth 32 of the ratchet bar 4. When the ratchet lever 19 is released, it again pivots, under the force of the tension spring 35, into its starting position illustrated in FIG. 2, whereby the driving pawl 22 now ratchets over the ratchet teeth 32, while the detent 29 prevents the ratchet bar 4 from sliding back. The projection 34 of the end portion 27 of the ratchet lever 19 is embodied in such a way that it does not come into contact with the detent 29 when the ratchet lever 19 is pressed. The initially straight tube 1 that is to be bent is placed in a known manner against either the blocks 40, 41 or the blocks 49, whereby these blocks, due to their ability to rotate freely, are disposed in such a way that the tube 1 engages the partially circular recesses 47, 48 of these blocks. As soon as, during advancement of the ratchet bar 4, the anvil 6 comes to rest against the tube region between the two blocks 40, 41 or 49, the tube, upon further advancement of the ratchet bar 4, is resiliently bent in the region between the blocks. Due to the relatively long ratchet lever 19, the forces that are necessary for the plastic or resilient bending of the tube 1 can be applied without difficulty. The tube 1 is then bent, in the region between the blocks 40, 41 or 49, in conformity with the radius of curvature of the recessed portion 51 of the respective anvil 6. During the bending process, the blocks 40, 41 or 49 are turned in such a way that the entire surfaces of the recesses 47, 48 thereof always rest against the tube 1.

When the bending process is concluded, the ratchet bar 4 must be returned to its starting position. For this purpose, with the inventive tube-bending device it is necessary to carry out only a single manipulation. In particular, it is merely necessary to pivot the ratchet lever 19 back counter to the direction of the arrow 53 beyond the starting position illustrated in FIG. 2, as a result of which the driving pawl 22 is freed from the ratchet bar 4, and in addition the detent 29 is pivoted about the journal pin 30 in a counterclockwise direction by the cooperating projections 33, 34 and against the force of the flat spring 28. In so doing, the detent 29 is also freed from the ratchet bar 4, which can then be easily shifted back into the starting position illustrated by solid lines in FIG. 2, or, due to its inherent weight, the ratchet bar 4 slides back into the starting position if the tube-bending device is in an upright position. In this way, the anvil 6 can be withdrawn without difficulty, so that the tube 1 can be easily removed at the conclusion of the bending process. Since a single manipulation only is required to release the ratchet bar 4, incorrect operations are precluded.

After the ratchet bar 4 has been released and returns to its starting position, the ratchet lever 19 is released. Under the force of the flat spring 28, the detent 29 again pivots back in a clockwise direction and is brought into engagement with the ratchet bar 4. Via the cooperating projections 33, 34, the ratchet lever 19 is, during this process again is pivoted back in a counterclockwise direction into the starting position shown in FIG. 2.

Since the holder 39 is provided on each side with a pair of blocks 40, 41, and 49, for these different bending radii no different holders are necessary. It is merely necessary to secure the holder 39 in the recessed portion 38 in such a way that in conformity with a desired bending radius, the required block pair is disposed in the bending region. The other pair of blocks 40 41, or 49 that is not needed for the bending process can serve to support the tube-bending device on a table or other base. In this way, a three-point support is achieved, thereby assuring a more reliable support of the tube-bending device in such a way that it will not tilt. This three-point support is particularly of great advantage if the tube-bending device rests upon the base during the bending process. To bend the tube, it is then merely necessary to press the main body 2 downwardly in the region of the guide part 3, as a result of which the aforementioned ratcheting process takes place, and the ratchet bar 4 along with the anvil 6 are shifted to the front against the appropriate pair of blocks. In this way greater forces can be applied, so that the tube-bending process can then also be undertaken in a simple manner when greater bending forces are required. In this connection, the described three-point support of the tube-bending device assures that the bending process can be carried out without any problems.

As shown in FIGS. 1 and 2, the crosspiece 11 of the guide part 3 is interrupted in the region of the guide surfaces 10. This makes it possible to finish the guide surfaces 10 in a simple manner. If the main body 2 is made of die cast metal, it is then possible via the openings 54, 55 to embody the die casting mold in such a way that the main body can already be produced with the guide surfaces 9, 10 during the die casting. It is then no longer necessary to carry out a finishing operation. Especially with this die casting process the production of the main body 2 of the inventive tube-bending device requires no or at best little finishing. It is essentially necessary only to produce the bores for receiving the journal pins 20 and 30 and to receive the attachment pin or part 36, and to produce the through bore 42.

The present invention is, of course, in no way restricted to the specific disclosure of the specification and drawings, but also encompasses any modifications within the scope of the appended claims.

What I claim is:

1. In a tube-bending device that comprises a main body, a ratchet lever pivotably mounted on said main body and movable against spring force, a driving pawl as well as a ratchet bar operatively associated therewith, said ratchet lever via said driving pawl engaging said ratchet bar that is displaceable guided in said main body as well as an anvil provided therewith, a detent also pivotably mounted on said main body and engaging said ratchet bar, including the improvement wherein:

a single holder having two sides is provided on said main body, with a first pair of blocks being disposed on one of said two sides of said single holder, as well as a second pair of blocks being disposed on the other of said two sides of said single holder, with a respective one of said pairs of blocks being provided for supporting a tube during a tube-bending process, said anvil, via displacement of said ratchet bar, being adapted to engage said tube, said pairs of blocks on said two sides of said single holder respectively having different spacing from each other to facilitate tube bending therebetween.

2. A tube-bending device according to claim 1, in which all of said blocks are freely rotatably mounted on said holder.

3. A tube-bending device according to claim 2, in which said main body has a recessed portion that extends transverse to the direction of displacement of said ratchet bar, with said recessed portion being provided for receiving said holder, which has a bar-like configuration.

4. A tube-bending device according to claim 3, in which said anvil is disposed on said ratchet bar in a frictionally engaging manner.

5. A tube-bending device according to claim 3, which includes first spring means for loading said detent in a direction towards its engagement position as to said ratchet bar; and in which said detent is adapted to be shifted by said ratchet lever into a release position in which said detent releases said ratchet bar.

6. A tube-bending device according to claim 5, in which said detent is provided with a first abutment member, and said ratchet lever is provided with a second abutment member, with said first and second abutment members cooperating with one another to effect said shifting of said detent into said release position.

7. A tube-bending device according to claim 6, in which said first abutment member is formed by a first projection on said detent, and said second abutment member is formed by a second projection on said ratchet lever.

8. A tube-bending device according to claim 6, in which said ratchet lever, during a ratcheting procedure to effect displacement of said ratchet bar, and hence said anvil, toward said holder, is adapted to be pivoted out of a starting position in a direction toward said main body, whereas to shift said detent into said release position, said ratchet lever is adapted to be pivoted out of its starting position in a direction away from said main body.

9. A tube-bending device according to claim 8, which includes second spring means that tend to load said ratchet lever in a direction toward said main body when said ratchet lever is in a pivoted position out of its starting position.

10. A tube-bending device according to claim 5, in which said first spring means is a flat spring upon which said detent rests.

11. A tube-bending device according to claim 1, in which said second pair of blocks and said ratchet lever project beyond the same side of said main body.

12. In a tube-bending device that comprises a main body, a ratchet lever pivotably mounted on said main body and movable against spring force, a driving pawl as well as a ratchet bar having teeth operatively associated in engagement therewith, said ratchet lever via said driving pawl engaging said ratchet bar that is displaceably guided longitudinally thereof in said main body as well as an anvil provided therewith, a detent also pivotably mounted on said main body and engaging said ratchet bar, including the improvement wherein:

a holder having two sides is provided on said main body, with a first pair of blocks being disposed on one of said two sides of said holder interchangeable on said main body as well as a second pair of blocks being disposed on the other of said two sides of said holder, with a respective one of said pairs of blocks being provided for supporting a tube during a tube-bending process, said anvil, via displacement of said ratchet bar, being adapted to engage said tube, said pairs of blocks respectively having different spacing from each other on respective sides of said holder.

13. In a tube-bending device that comprises a main body, a ratchet lever pivotably mounted on said main body, a driving pawl as well as a ratchet bar operatively associated therewith, said ratchet lever via said driving pawl engaging said ratchet bar that is displaceably guided in said main body as well as an anvil provided therewith, a detent also pivotably mounted on said main body and engaging said ratchet bar, including the improvement wherein:

a holder having two sides is provided on said main body, with a first pair of blocks being disposed on one of said sides of said holder, as well as a second pair of blocks being disposed on the other of said sides of said holder, with a respective one of said pairs of blocks being provided for supporting a tube during a tube-bending process, said anvil, via displacement of said ratchet bar, being adapted to engage said tube; and first spring means for loading said detent in a direction towards its engagement position; said detent being adapted to be shifted by said ratchet lever in a release position in which said detent releases said ratchet bar.

14. A tube-bending device according to claim 13, in which said blocks of said second pair of blocks are spaced from one another by a distance that differs from the distance by which said blocks of said first pair of blocks are spaced from one another.

15. A tube-bending device according to claim 13, in which said first spring means is a flat spring upon which said detent rests.

16. A tube-bending device according to claim 13, in which said detent is provided with a first abutment member, and said ratchet lever is provided with a second abutment member, with said first and second abutment members cooperating with one another to effect said shifting of said detent into said release position.

17. A tube-bending device according to claim 15, in which said first abutment member is formed by a first projection on said detent, and said second abutment member is formed by a second projection on said ratchet lever.

18. A tube-bending device according to claim 15, in which said ratchet lever, during a ratcheting procedure to effect displacement of said ratchet bar, and hence said anvil, toward said holder, is adapted to be pivoted out of a starting position in a direction toward said main body, whereas to shift said detent into said release position, said ratchet lever is adapted to be pivoted out of its starting position in a direction away from said main body.

19. A tube-bending device according to claim 17, which includes second spring means that tend to load said ratchet lever in a direction toward said main body when said ratchet lever is in a pivoted position out of its starting position.

* * * * *